US009252542B2

(12) United States Patent
Little et al.

(10) Patent No.: US 9,252,542 B2
(45) Date of Patent: Feb. 2, 2016

(54) ELECTRICAL CONNECTOR WITH SHIELDING PLATE THEREOF

(71) Applicant: HON HAI PRECISION INDUSTRY CO., LTD., New Taipei (TW)

(72) Inventors: Terrance F. Little, Fullerton, CA (US); An-Jen Yang, Irvine, CA (US); Chien-Ping Kao, Hummels town, PA (US); Yu-Hsu Chen, New Taipei (TW); Hsueh-Lung Hsiao, New Taipei (TW); Kuo-Chun Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 2 days.

(21) Appl. No.: 14/198,582

(22) Filed: Mar. 5, 2014

(65) Prior Publication Data

US 2014/0187086 A1 Jul. 3, 2014

Related U.S. Application Data

(63) Continuation-in-part of application No. 13/479,289, filed on May 24, 2012, now Pat. No. 8,684,769, and a continuation-in-part of application No. 14/149,788, filed on Jan. 7, 2014.

(60) Provisional application No. 61/773,150, filed on Mar. 6, 2013.

(51) Int. Cl.

| | |
|---|---|
| ***H01R 13/648*** | (2006.01) |
| ***H01R 13/6585*** | (2011.01) |
| *H01R 13/516* | (2006.01) |
| *H01R 24/60* | (2011.01) |

(52) U.S. Cl.
CPC ..... *H01R 13/6585* (2013.01); *H01R 13/516* (2013.01); *H01R 24/60* (2013.01)

(58) Field of Classification Search
CPC ..... H01R 13/658; H01R 13/65802; H01R 13/74; H01R 23/6873; H01R 23/7073
USPC ..... 439/607.28, 607.11, 607.41
See application file for complete search history.

(56) References Cited

U.S. PATENT DOCUMENTS

| | | | | |
|---|---|---|---|---|
| 7,591,683 | B2 * | 9/2009 | Zhang et al. | 439/638 |
| 7,632,155 | B1 * | 12/2009 | Wu | 439/660 |

(Continued)

FOREIGN PATENT DOCUMENTS

| | | | |
|---|---|---|---|
| CN | 2422734 | Y | 3/2001 |
| CN | 200965950 | Y | 10/2007 |
| CN | 101106229 | A | 1/2008 |

*Primary Examiner* — Abdullah Riyami
*Assistant Examiner* — Vladimir Imas
(74) *Attorney, Agent, or Firm* — Wei Te Chung; Ming Chieh Chang

(57) ABSTRACT

An electrical connector includes a metallic shell defining a mating cavity opening forwards, a terminal module assembly received in the metallic shell, and a shielding plate being located between an upper surface and a lower surface of the terminal module assembly. The terminal module assembly defines a front region exposed in the mating cavity to function as a mating tongue. The terminal module assembly defines an insulator associated with a plurality of contacts with corresponding contacting sections exposed upon opposite upper and lower faces of the mating tongue, the contacts are categorized with differential pairs and grounding contacts. The shielding plate defines a main plate and grounding fingers split from the main plate to directly touch with corresponding grounding contacts. The shielding plate is embedded with the terminal module assembly and the grounding fingers of the shielding plate are fixed with the insulator of the terminal assembly.

20 Claims, 18 Drawing Sheets

(56) References Cited

U.S. PATENT DOCUMENTS

| | | | | |
|---|---|---|---|---|
| 7,744,416 | B2 * | 6/2010 | Zhang et al. | 439/607.11 |
| 7,748,999 | B1 * | 7/2010 | Sun et al. | 439/79 |
| 8,251,746 | B2 * | 8/2012 | Zhang et al. | 439/607.11 |
| 8,262,411 | B2 * | 9/2012 | Kondo | 439/607.01 |
| 8,500,494 | B2 * | 8/2013 | Wu | 439/660 |
| 8,684,769 | B2 * | 4/2014 | Kao et al. | 439/607.28 |
| 8,702,451 | B2 * | 4/2014 | Luo et al. | 439/607.28 |
| 2012/0156943 | A1 * | 6/2012 | Wu | 439/676 |
| 2013/0316581 | A1 * | 11/2013 | Kao et al. | 439/607.28 |

* cited by examiner

ELECTRICAL CONNECTOR WITH SHIELDING PLATE THEREOF

CROSS REFERENCE TO RELATED APPLICATIONS

This application claims the benefit of, and priority to, U.S. Provisional Patent Application No. 61/773,150, filed Mar. 6, 2013, the contents of which are incorporated entirely herein by reference. This application is a continuation-in-part (CIP) application of both of the copending application Ser. No. 13/479,289 filed May 24, 2012 and Ser. No. 14/149,788 filed Jan. 7, 2014 which claims benefit of a provisional application Ser. No. 61/750,312 filed Jan. 8, 2013.

BACKGROUND OF THE INVENTION

1. Field of the Invention

The present invention relates to an electrical receptacle connector, and more particularly to an I/O receptacle connector having a mating tongue with contacting sections of the corresponding contacts on two opposite surfaces thereon wherein a shielding/reinforcement plate between the two opposite surface under condition that the shielding/reinforcement plate are mechanically and electrically connected to some of the grounding contacts.

2. Description of Related Art

A connector capable of transmitting high-speed differential signals is used as an interface connector or an internal connector of a digital appliance or a PC. Such connector includes a plurality of signal contacts and a plurality of ground contacts. The signal contacts are paired in order to transmit differential signals in the manner known in the art. Generally, on the side of a fitting portion or a contacting portion side of the connector is fitted to or contacted with a mating connector. On the other hand, on the terminal portion side of the contacts to be connected to a board, the terminal portions are arranged in a plurality of rows because the terminal portions are inserted into a plurality of through holes, respectively.

At present, transmission of high-speed differential signals is required in a growing number of software applications. Under the circumstances, there is a demand for an improved connector having a compact size, a low piece, and excellent high-frequency characteristics.

SUMMARY OF THE INVENTION

Accordingly, an object of the present invention is to provide an electrical connector. The electrical connector comprises a metallic shell defining a mating cavity opening forwards, a terminal module assembly received in the metallic shell, and a shielding plate being located between an upper surface and a lower surface of the terminal module assembly. The terminal module assembly defines a front region exposed in the mating cavity to function as a mating tongue. The terminal module assembly defines an insulator associated with a plurality of contacts with corresponding contacting sections exposed upon opposite upper and lower faces of the mating tongue, said contacts are categorized with differential pairs and grounding contacts. The shielding plate defines a main plate and grounding fingers split from the main plate to directly touch with corresponding grounding contacts. The shielding plate is embedded with the terminal module assembly and the grounding fingers of the shielding plate are fixed with the insulator of the terminal assembly.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the first preferred embodiment of the present invention.

Figure 1:
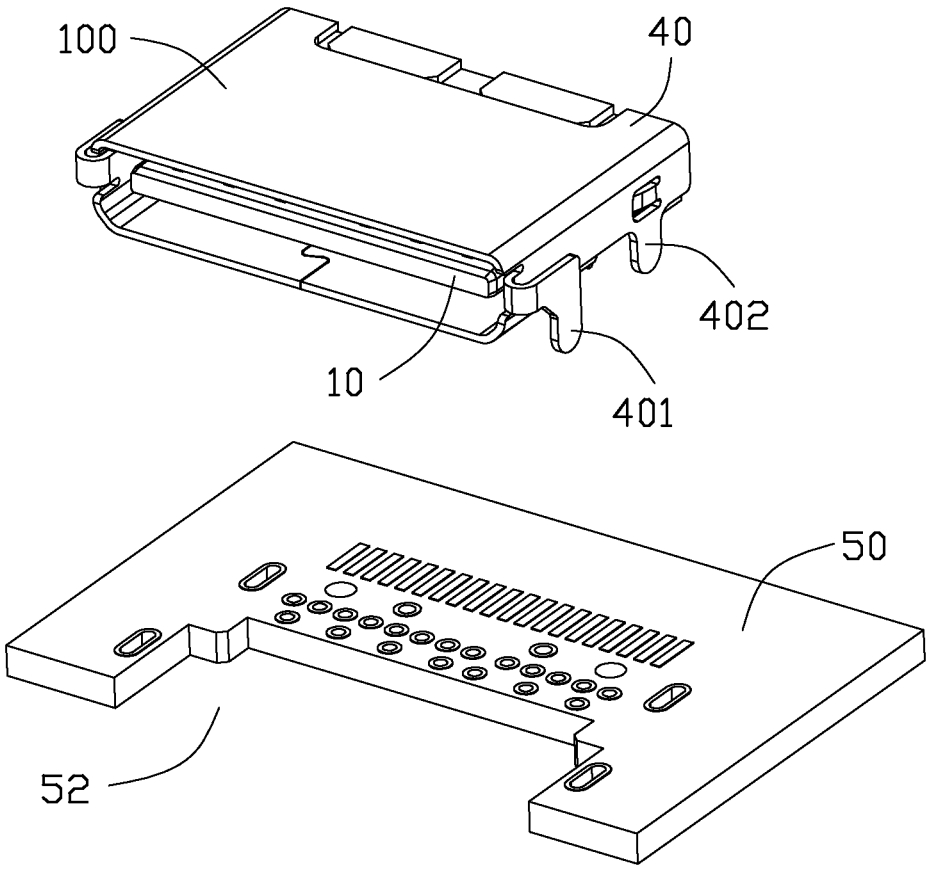
FIG. 1 is an exploded perspective view of a receptacle connector and a printed circuit board on which the connector is mounted, in accordance with a first embodiment of the present invention.
Figure 2:
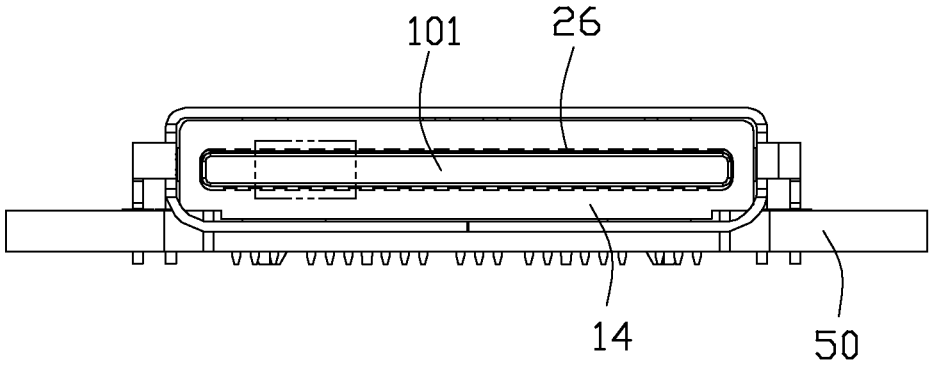
FIG. 2 is a front elevational view of the receptacle connector mounted on the printed circuit board of FIG. 1.
Figure 3:
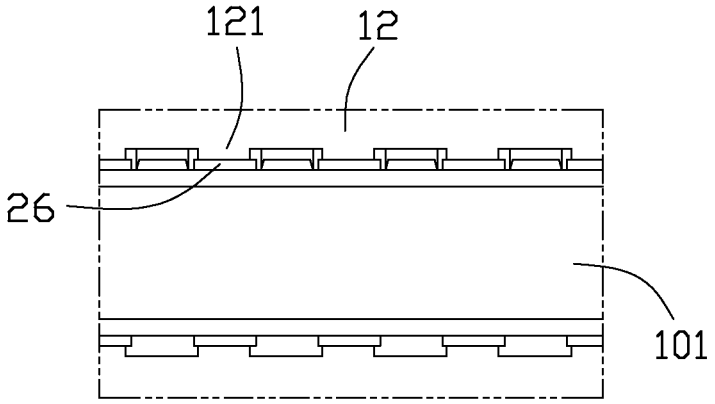
FIG. 3 is an enlarged partial front elevational view of the receptacle connector shown in FIG. 2.

Referring to FIGS. 1 through 4, in a first embodiment an electrical receptacle connector 100 which is adapted to be mounted to a printed circuit board (PCB) 50 wherein the printed circuit board 50 defines a notch 52 in which a lower portion of the connector 100 is disposed so as to form a sink type arrangement. The connector 100 includes an insulating seat 10 loaded with contacts 26 and a metallic shell 40 surrounding the insulating seat 10, thereby defining a mating cavity 14 extending forwards in a front-and-back direction. The insulating seat 10 defines a mating tongue 101 extending forwards and into the mating cavity 14. The metallic shell 40 defines a pair of front legs 401 and a pair of rear legs 402 along the front-to-back direction thereof, which are adapted for being mounted on the PCB 50. The insulating seat 10 mainly includes an insulating compression housing 12 with a receiving cavity 120 and a terminal module assembly 20 is inserted into and then retained in the receiving cavity 120 of the insulating compression housing 12. A plurality of compression lugs 121 are formed on a front region of the housing 12 around the receiving cavity 120 to press against the contacts 26. The housing 12 defines thin lugs 122 along the front region of the housing and the metallic shell 40 is interfered with the thin lugs 122 for a good retention between the housing and the shell. The very brief overview of the electrical connector 100 is given. The detail structure of elements of the electrical connector 100 and an assembly of the electrical connector 100 will be given hereinafter Referring to FIGS. 5 through 6, the terminal module assembly 20 is, from a rear side of the housing 12, inserted into and disposed in the receiving cavity 120. The housing 12 defines a front longitudinal opening 123 and a rear receiving recess 124 opening to the rear face and bottom thereof, both of which commonly form said receiving cavity 120. The terminal module assembly 20 includes a front region 201 and a rear region 202, the front region projecting beyond a front face 125 of the housing 12 through the longitudinal opening 123, therefore the front region 201 is functioned as the mating tongue 101 which is received in the receiving cavity 14 as shown in FIG. 2. The rear region 202 is received the receiving recess 124 when the terminal module assembly 20 is inserted from the rear face of the housing 12. The terminal module assembly 20 comprises two rows of contacts 26 arranged on opposite surfaces thereof and the terminal module assembly 20 is embedded with a shielding plate 30 between the upper and lower rows of the contacts 26 which will be described thereinafter. Legs 262*a*, 262*b* of the contacts are arranged on the rear faces and bottom face of the insulating seat 10 respectively.

Figure 4:
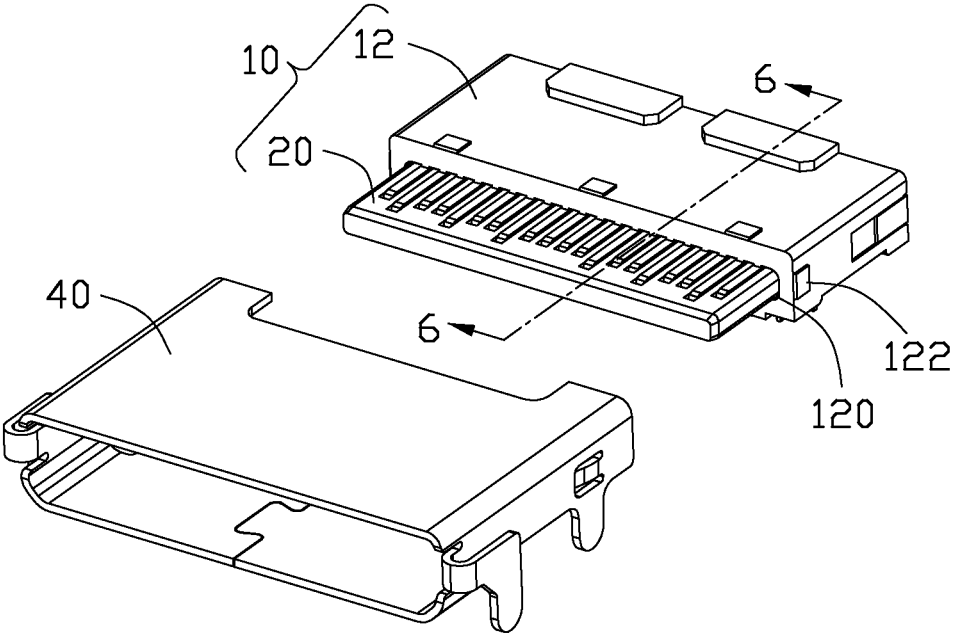
FIG. 4 is an exploded perspective view of the receptacle connector of FIG. 1.
Figure 5:
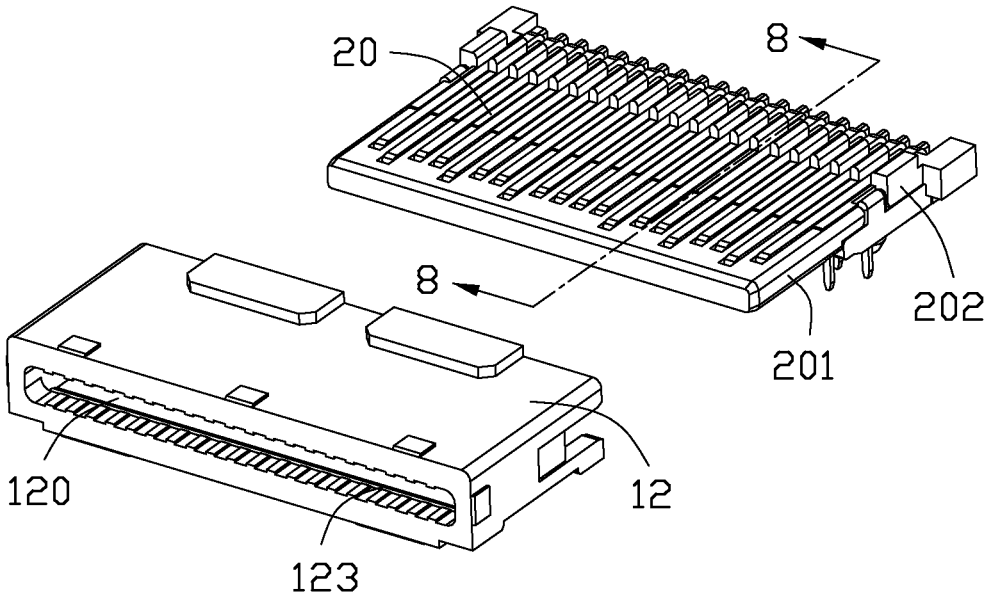
FIG. 5 is an exploded perspective view of the insulating seat of FIG. 4.
Figure 6:
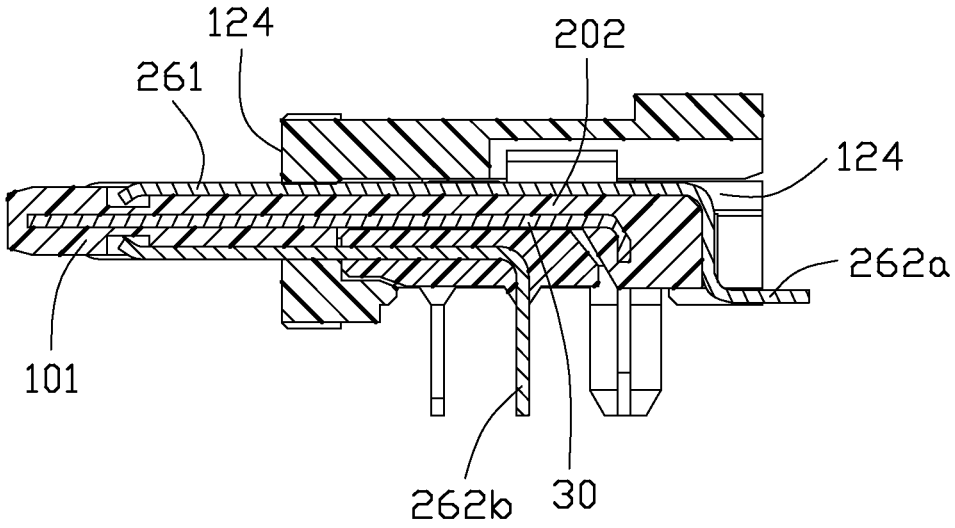
FIG. 6 is a cross-sectional view of the insulating seat along broken lines 6-6 of FIG. 4.
Figure 7:
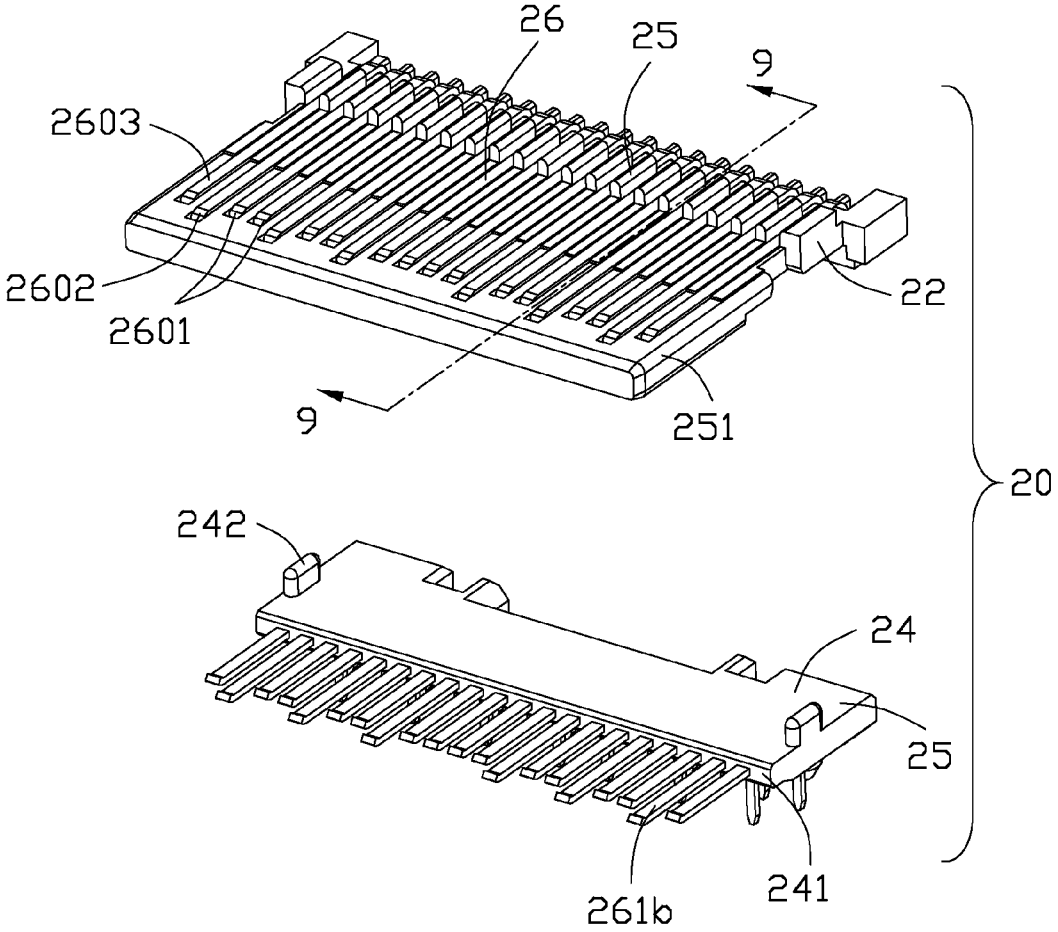
FIG. 7 is an exploded perspective view of the terminal module assembly of FIG. 5.
Figure 8:
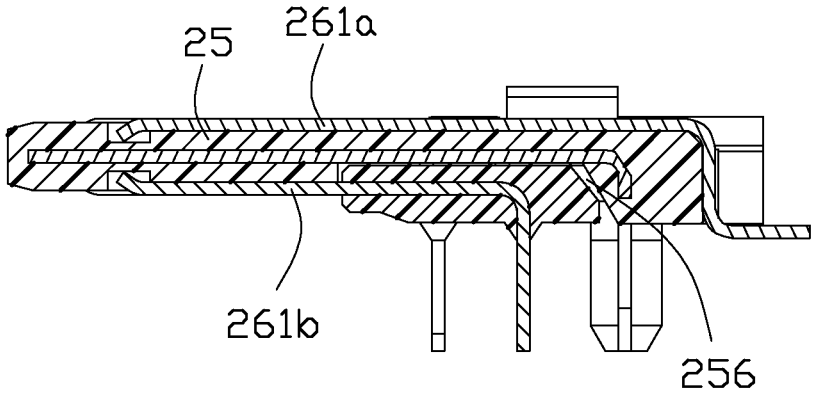
FIG. 8 is a cross-sectional view of the insulating seat along broken lines 8-8 of FIG. 5.

Referring to FIGS. 5, 7 and 8, the terminal module assembly 20 includes an upper terminal module 22 and a lower terminal module 24. Each of the upper terminal module 22 and the lower terminal module 24 includes an insulator 25 associated with the plurality of contacts 26. The contacts 26 are categorized with differential pairs 2601, grounding contacts 2602 and power contacts 2603, wherein the grounding contacts 2602 is longer than the differential pairs and power contacts 2603 in the front-to-back direction. The insulator 25 of the upper terminal module 22 defines a complete front region 251 which is functioned as the mating tongue 101 as shown in FIGS. 2 and 4. The contacts 26 of the lower terminal module 22 are integrally formed with the insulator 25 of the lower terminal module 24 via an insert molding process. The contacting sections 261*b* of the contacts in the lower terminal module 24 project forwards beyond a front face 241 of insulator of the lower terminal module. Combination with FIG. 9, the insulator 25 of the upper terminal module 22 further defines a plurality of lower grooves 255 in the lower face 254 to receive the contact portions 261*b* of the contacts 26 of the lower terminal module 24 and a rear recess 256 to receive the insulator of the lower terminal module 24. The insulator 25 of the lower terminal module 24 is equipped with a pair of latches 242 at two opposite lateral sides to lock to the insulator 25 of the upper terminal module 22 when the lower terminal module 24 is inserted into the rear recess 256 from a lower-to-upper direction. The contacts 26 of the upper and lower rows are aligned with each other in the lower-and-upper direction.

Figure 9:
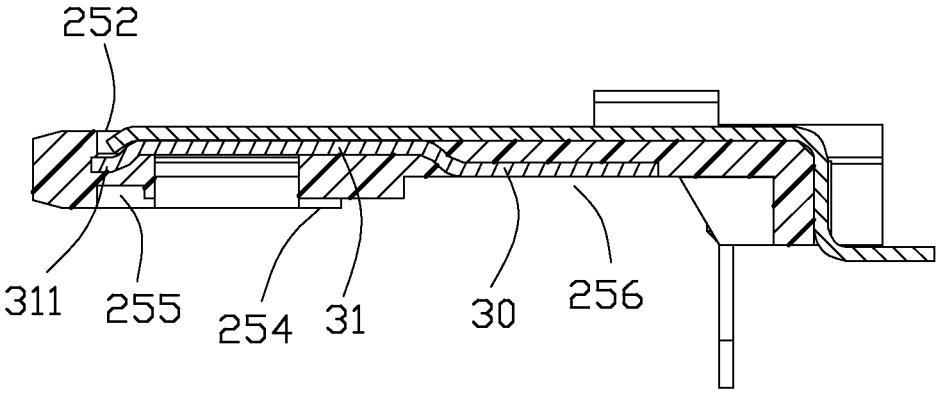
FIG. 9 is a cross-sectional view of the upper terminal module along broken lines 9-9 of FIG. 7.
Figure 10:
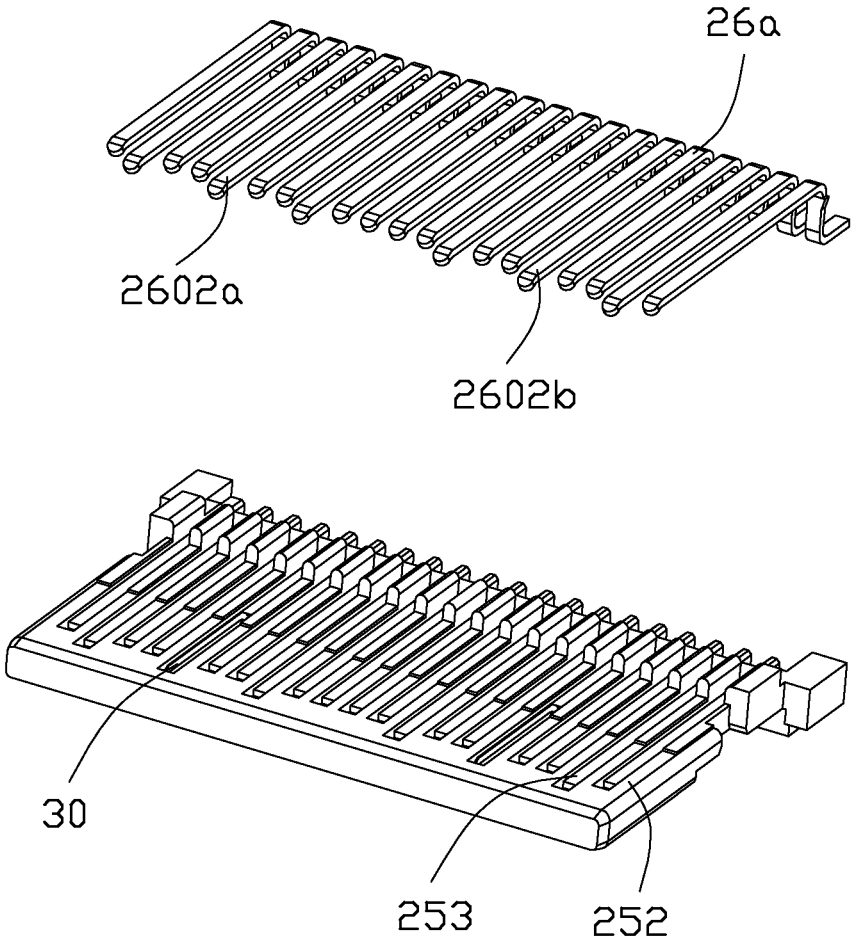
FIG. 10 is an exploded perspective view of the upper terminal module of FIG. 7.
Figure 11:
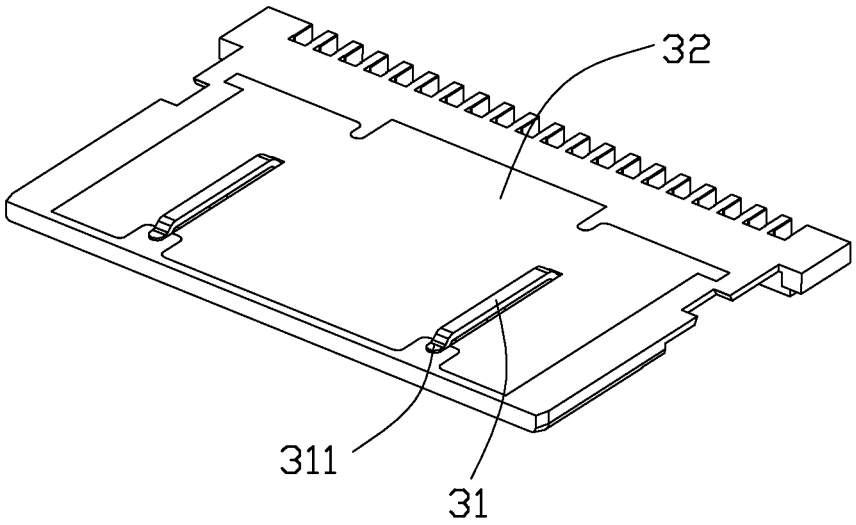
FIG. 11 is a perspective view of the upper terminal module of FIG. 7, wherein an upper portion of the upper terminal module is removed to clearly show the shielding plate.
Figure 12:
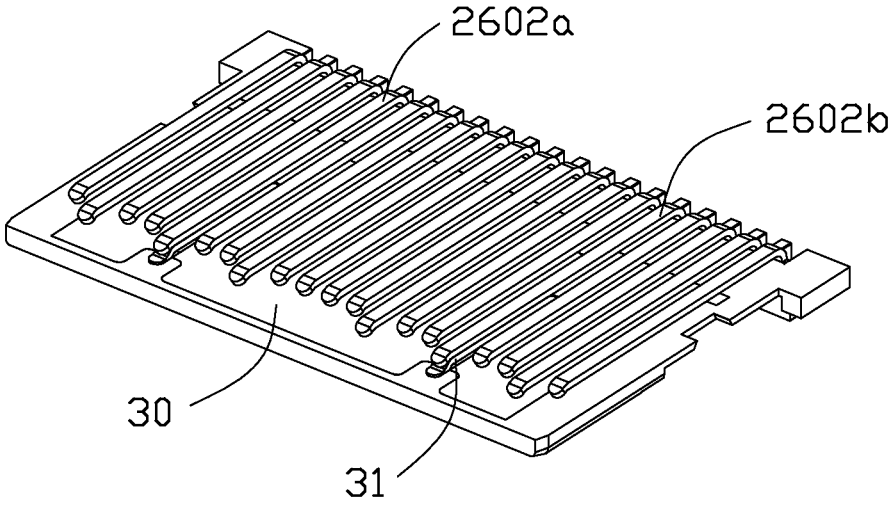
FIG. 12 is a perspective view of the upper terminal module of FIG. 7, wherein an upper portion of the upper terminal module is removed to clearly show an engagement of the contacts and the shielding plate.
Figure 13:
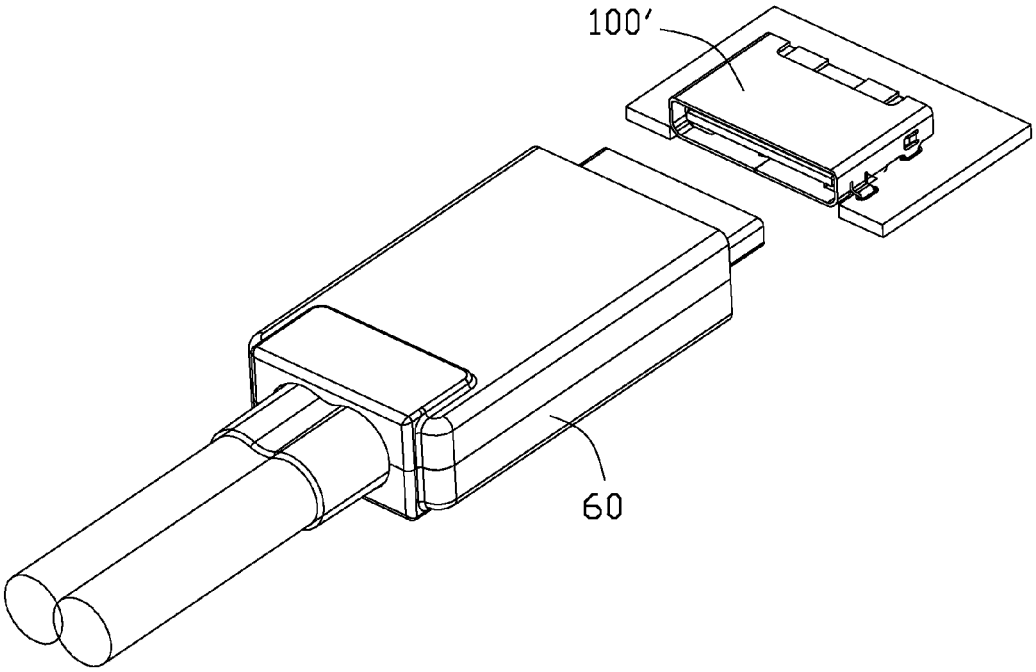
FIG. 13 is a perspective view of a receptacle connector in accordance with a the present invention, which is adapted for mating with a plug connector.
Figure 14:
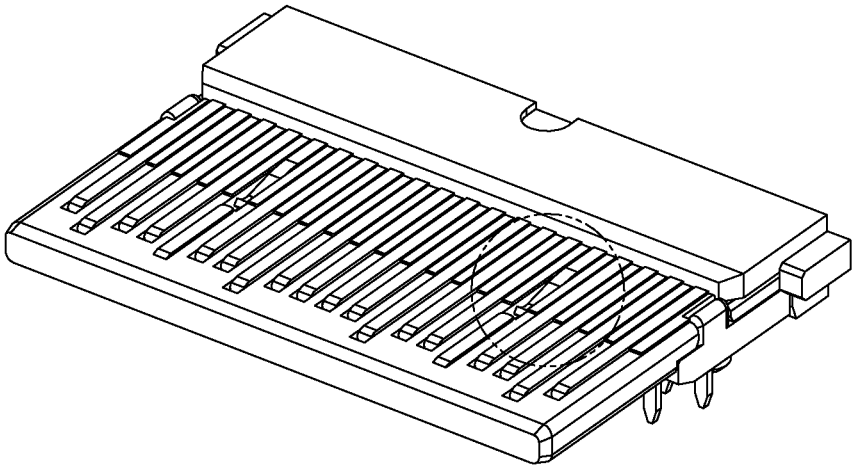
FIG. 14 is a perspective view of an insulating seat in accordance with a second embodiment of the present invention.
Figure 15:
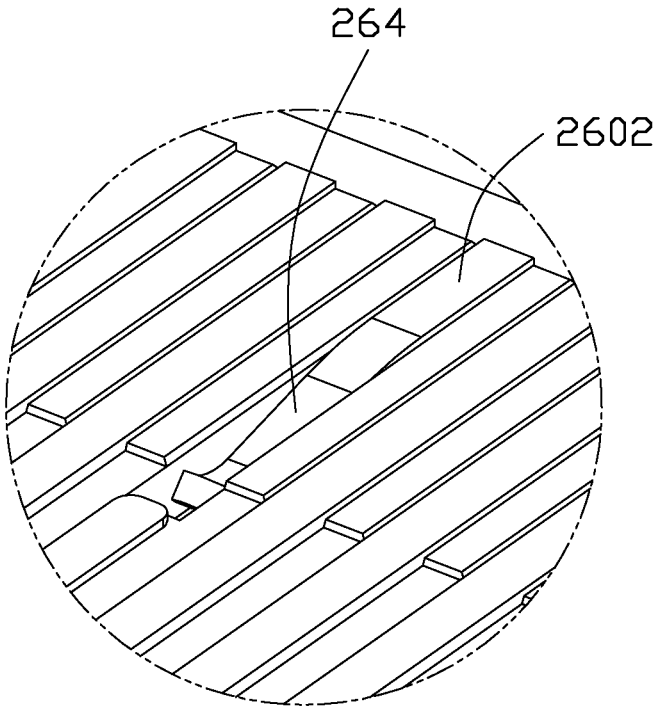
FIG. 15 is an enlarged partial perspective view of the insulating seat of FIG. 14.
Figure 16:
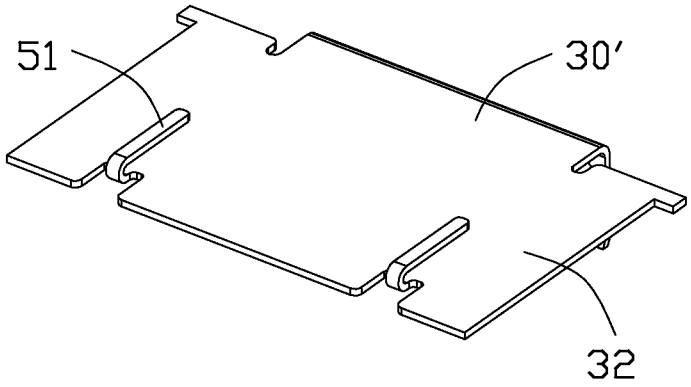
FIG. 16 is a perspective view of shielding plate assembled in the insulating seat of FIG. 14.

Referring to FIGS. 7 and 9-12, the upper terminal module 22 further is equipped with the shielding plate 30 integrally embedded therein via an insert molding process wherein two grounding fingers 31 extend upward to be exposed upon an upper face 253 of the upper terminal module 22 as best shown in FIGS. 9 and 10. The shielding plate is unitarily formed with the corresponding insulator via an insert molding process. A plurality of upper grooves 254 are formed in the upper face 253 of the upper terminal module 22, and the contacts 26*a* of the upper terminal module 22 are downwardly inserted into and then received within the corresponding upper grooves 253 in the upper face 252, respectively, wherein two grounding contacts 2602*a*, 2602*b* downwardly press against the corresponding two grounding fingers 31, respectively. Please notes, the shielding plate 30 is firstly embedded in the insulator of the upper module and then the upper contacts 26*a* are inserted in to the insulator as shown in FIG. 10. As shown in FIGS. 11 and 12 wherein the upper portion of the insulator 25 of the upper terminal module 22 is cut away to best show the shielding plate 30, the shielding plate 30 has a main plate 32 and two grounding fingers 31 are split from a front edge of the main plate and bending upwards so as to contact the grounding contacts. A front distal free end 311 of each grounding finger 31 bends downward and substantially co-planes with the main plate as best shown in FIGS. 8 and 9, the shielding plate 30 projects forwards beyond the contacts 26. As shown in FIG. 12, the grounding contacts 2602*a*, 2602*b* contacts with the grounding fingers 31 while other grounding contacts are separated from the shielding plate 28. The grounding fingers 31 of the shielding plate are fixed with the insulator of the terminal assembly, i.e., the grounding fingers 31 being immovably supported by material of the insulator 25 and can not move in the vertical direction.

As mentioned earlier, the assembled terminal module assembly 20 is assembled into the receiving cavity 120 of the compression housing 12 wherein the compression lugs 121 press the corresponding contacts 26, respectively, to assure the contacts 26 are firmly received in the corresponding grooves 253, 255, respectively. Understandably, the selected two grounding contacts 2602*a*, 2602*b* are forced to press against the corresponding grounding fingers 31 by the corresponding compression lugs 121 to establish the reliable grounding effect. Clearly, the front portion of the terminal module assembly 20 extends forwardly beyond the housing 12 to be functioned as the mating tongue 101.

The assembled housing 12 and terminal module assembly 20 are further forwardly assembled into the metallic shell 40 to form the complete connector 100 which is adapted to be mounted to the printed circuit board 50.

Referring to FIGS. 13 through 17, in an alternative or second embodiment those two selected grounding contacts 2602 of the electrical receptacle connector 100' extend downwardly to directly contact the main plate 32 of the shielding plate 30' rather than contacting the grounding fingers 31. On the other hand, the shielding plate 30' further includes two folded type tip sections 51 in front of those two selected grounding contacts in the front-to-back direction so as to comply with the mated plug 60 disclosed in FIG. 13. Understandably, the folded type tip sections 51 also reinforce securement between the insulator 25 of the upper terminal module 22 and the shielding plate 30'. Each of the select two contacts 2602 has an elastic arm 264 extending downwards to press against the main plate 32 of the shielding plate 30'. The shielding plate defines leg 33 to be soldered to the PCB. The elastic arm 264 and the folded type tip section 51 are aligned with each other in the front-and-back direction. Understandably, the contact 2602 is shorter than other adjacent contacts so as to improve impedance and reduce crosstalk between adjacent pairs.

Figure 17:
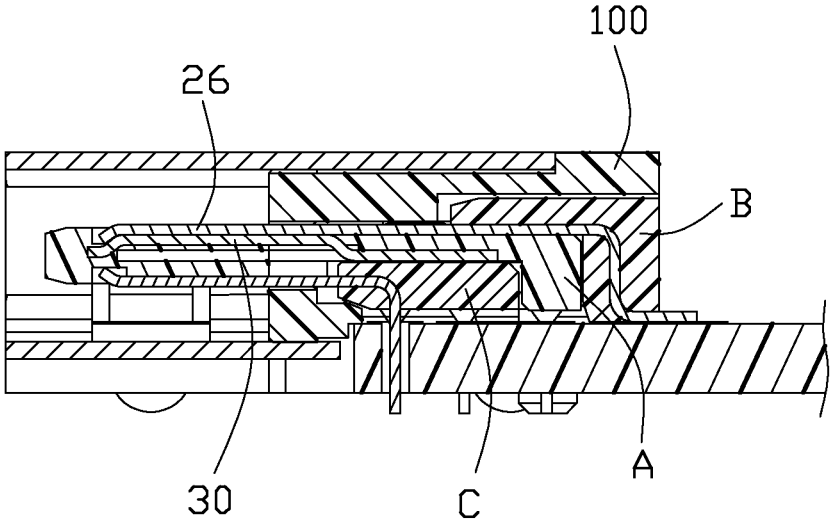
FIG. 17 is a cross-sectional view of the receptacle connector of the first embodiment.
Figure 18:
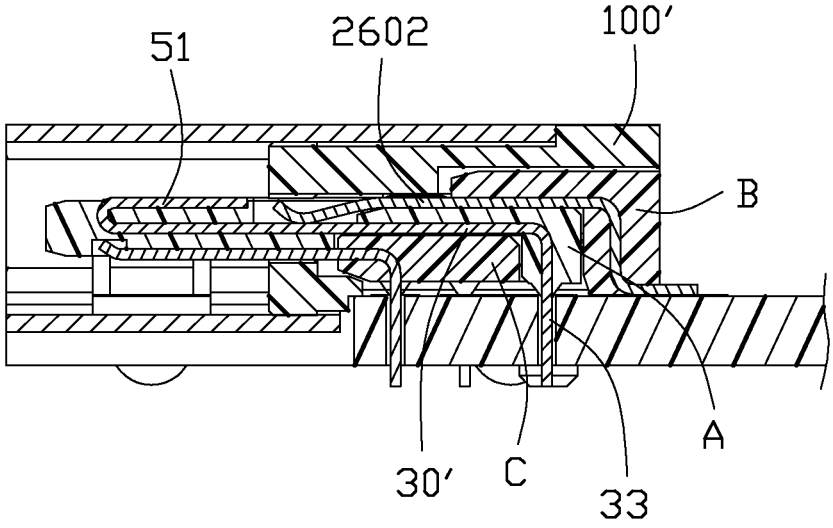
FIG. 18 is a cross-sectional view of the receptacle connector of the second embodiment.

Referring to FIGS. 17 and 18 shown the difference engagement of the grounding contacts of the first embodiment and the second embodiment, the corresponding grounding terminal of the plug 60 directly contacts the corresponding grounding contact 26 of the connector 100 which presses the corresponding grounding finger 30 in the first embodiment as shown in FIG. 17 while the grounding terminal of the plug 60 directly contacts the folded type tip section 51 without contacting the grounding contact 2602 in the second embodiment as shown in FIG. 18. It is noted that in these embodiments, the upper terminal module includes a front insulator unit A and a rear insulator unit B rather than one insulator disclosed in the previous embodiments, wherein the front/middle insulator unit A forms the mating tongue with the shielding plate embedded therein via an insert-molded manner while the rear/upper insulator unit B is associated with the corresponding contacts in an insert-molded manner. Therefore, the rear insulator unit B with the associated contacts 26 is downwardly assembled to an upper side of the front insulator unit A, and the (lower) insulator C of the lower terminal module with the associated contacts 26 is upwardly assembled to the lower side of the front insulator unit A, and then all the front insulator unit A, the rear insulator unit B and the insulator C of the lower terminal module are commonly forwardly assembled into the housing 100/100'.

While a preferred embodiment in accordance with the present invention has been shown and described, equivalent modifications and changes known to persons skilled in the art according to the spirit of the present invention are considered within the scope of the present invention as described in the appended claims

What is claimed is:

1. An electrical connector comprising:

an insulating housing defining a receiving cavity extending therethrough in a front-to-back direction;

a terminal module assembly assembled into the receiving cavity with a front region extending forwardly beyond the housing to function as a mating tongue;

said terminal module assembly including an upper terminal module and a lower terminal module assembled with each other, each of said upper terminal module and the lower terminal module defining an insulator associated with a plurality of contacts with corresponding contacting sections exposed upon opposite upper and lower faces of one of the upper terminal module and the lower terminal module, said contacts being categorized with differential pairs and grounding contacts; and a metallic shielding plate embedded within the insulator of said one of the upper terminal module and the lower terminal module between said opposite upper and lower faces; wherein some grounding contacts extend mechanically and electrically connect to the shielding plate; wherein the housing defines a plurality of compression lugs press against the contacting sections of the corresponding contacts, respectively, to assure the contacting sections of the contacts will not move away from said one of the upper terminal and the lower terminal in a vertical direction perpendicular to said front-to-back direction.

2. The electrical connector as claimed in claim 1, wherein said contacts are assembled with regard to said one of the upper terminal and the lower terminal in said vertical direction.

3. The electrical connector as claimed in claim 1, wherein said shielding plate is unitarily formed with the corresponding insulator via an insert molding process.

4. The electrical connector as claimed in claim 1, wherein the upper terminal module defines a rear recess and the lower terminal module is received in the rear recess.

5. The electrical connector as claimed in claim 4, wherein said other of the upper terminal module and the lower terminal module and said one of the upper terminal module and the lower terminal module are configured to be assembled to each other in the vertical direction.

6. The electrical connector as claimed in claim 1, wherein said grounding contacts directly contact the grounding fingers unitarily extending from a main plate of the shielding plate.

7. The electrical connector as claimed in claim 1, wherein said upper face and said lower face of said one of the upper terminal module and the lower terminal module form a plurality of grooves to receive the contacting sections of the corresponding contacts, respectively.

8. An electrical connector comprising:

a metallic shell defining a mating cavity opening forwards;

an insulating seat loaded with a terminal module assembly and received in, the metallic shell, the terminal module assembly defining a front region exposed in the mating cavity to function as a mating tongue;

said terminal module assembly comprising a first terminal module and a second terminal module assembled with each other in a vertical direction, each of said first terminal module and the second terminal module defining an insulator associated with a plurality of contacts with corresponding contacting sections, the contacting sections of said first terminal module and the contacting sections of said second terminal module being respectively exposed upon opposite upper and lower faces of the mating tongue, said contacts of the first terminal module being categorized with differential pairs and grounding contacts; and a shielding plate being embedded within the insulator of the first terminal module and located between the contacts of the first terminal module and the contacts of the second terminal module in the vertical direction, some grounding contacts of the first terminal module extend mechanically and electrically connect to the shielding plate; wherein the shielding plate is unitarily formed with the insulator of the first terminal module via an insert molding process.

9. The electrical connector as claimed in claim 8, wherein the insulator of the first terminal module defines a plurality of grooves on an upper surface and a lower surface thereof, the contacting sections of the first terminal module are receiving the grooves of the upper surface, respectively; the contact sections of the second terminal module extend beyond a front surface of the insulator of the second terminal module, the contacting sections of the second terminal module are received in the grooves on the lower surface when the insulator of the second terminal module is received in a rear recess defined in a rear region of the insulator of the second terminal module.

10. The electrical connector as claimed in claim 8, wherein the shielding plate is split with grounding fingers which touch with said grounding contacts.

11. The electrical connector as claimed in claim 10, wherein the grounding fingers are fixed with the insulator of the first terminal module.

12. The electrical connector as claimed in claim 8, wherein the shielding plate defines legs which are adapted for being soldered to a printed circuit board.

13. An electrical connector comprising:

a metallic shell defining a receiving cavity therein;

a terminal module assembly assembled into the receiving cavity with a front region extending forwardly in a front-to-back direction and functioning as a mating tongue to communicate forwardly to an exterior in said front-to-back direction;

said terminal module assembly comprising a first terminal module and a second terminal module assembled with each other in a vertical direction perpendicular to said front-to-back direction, each of said first terminal module and the second terminal module defining an insulator associated with a plurality of contacts with corresponding contacting sections, the contacting sections of said first terminal module and the contacting sections of said second terminal module being respectively exposed upon opposite upper and lower faces of the mating tongue, said contacts of the first terminal module being categorized with differential pairs and grounding contacts; and a metallic shielding plate being embedded within the insulator of the first terminal module and located between the contacts of the first terminal module and the contacts of the second terminal module in the vertical direction; wherein the shielding plate is unitarily formed with the insulator of the first terminal module via an insert molding process.

14. The electrical connector as claimed in claim 13, wherein both said first terminal module and said second terminal module includes means to prevent a relative movement between the first terminal module and the second terminal module horizontally.

15. The electrical connector as claimed in claim 13, wherein the shielding plate includes a horizontal section embedded within the insulator of the first terminal module, and a vertical section located behind the horizontal section and extending downwardly beyond a lower surface of the insulator of the first terminal module.

16. The electrical connector as claimed in claim 13, wherein the shielding plate includes a folded type tip section in front of one corresponding grounding contact.

17. The electrical connector as claimed in claim 13, wherein the shielding plate includes a spring finger located behind the corresponding grounding contact in the vertical direction.

18. The electrical connector as claimed in claim 13, wherein the mating tongue is made by the insulator of the first terminal module without involvement with the insulator of the second terminal module.

19. The electrical connector as claimed in claim 13, wherein the first terminal module is located above the second terminal module.

20. The electrical connector as claimed in claim 19, wherein the contacts of the first terminal module form horizontal tails while the contacts of the second terminal module form vertical tails.

* * * * *